US005258228A

United States Patent [19]

Komuro

[11] Patent Number: 5,258,228

[45] Date of Patent: Nov. 2, 1993

[54] INFRARED SLIGHT ENERGY RADIATION POWDER AND SYNTHETIC FIBER CONTAINING SAID RADIATION POWDER MIXED THEREIN AND FIBER ARTICLES, COMPRISING SAID FIBER

[76] Inventor: Toshio Komuro, Rm. 301, Nissei Mansion, 23-8, Toyotamakita 4-chome, Nerima-ku, Tokyo, Japan

[21] Appl. No.: 507,532

[22] Filed: Apr. 11, 1990

[30] Foreign Application Priority Data

Dec. 20, 1989 [JP] Japan ..... 1-328396

[51] Int. Cl.[5] ..... B32B 18/00; B32B 19/00

[52] U.S. Cl. ..... 428/402; 428/357; 428/367; 501/97; 501/153

[58] Field of Search ..... 428/402; 501/153, 97

[56] References Cited

U.S. PATENT DOCUMENTS

| | | | |
|---|---|---|---|
| 3,607,343 | 9/1971 | Longo et al. | 428/404 |
| 3,715,265 | 2/1973 | Allen et al. | 428/357 |
| 4,377,618 | 3/1983 | Ikeda et al. | 428/403 |
| 4,686,791 | 8/1987 | Miyata | 524/437 |
| 4,746,638 | 5/1988 | Hori et al. | 501/153 |
| 4,999,243 | 3/1991 | Maeda | 428/372 |
| 5,032,376 | 7/1991 | Kladnig | 501/153 |

FOREIGN PATENT DOCUMENTS

| | | | |
|---|---|---|---|
| 0086952 | 7/1981 | Japan | 428/402 |
| 1-24837 | 5/1989 | Japan . | |

*Primary Examiner*—Patrick J. Ryan
*Assistant Examiner*—J. M. Gray
*Attorney, Agent, or Firm*—Lowe, Price, LeBlanc & Becker

[57] ABSTRACT

This invention relates to infrared slight energy radiation powder and synthetic fiber containing the radiation powder mixed therein and fiber articles made of the synthetic fiber.

The radiation powder comprising chiefly alumina, titanium and platinum or palladium, or, alumina, silica and palladium provides sufficient quantities of infrared slight energy radiation having a wide wavelength range. The clothes and bedding made of the synthetic fiber containing infrared slight energy radiation powder are warm and heat-retaining. And the wrapping articles for fresh meat and fish made in relation with the present invention are antibacterial and effective for keeping freshness of the wrapped food.

3 Claims, 3 Drawing Sheets

INFRARED SLIGHT ENERGY RADIATION POWDER AND SYNTHETIC FIBER CONTAINING SAID RADIATION POWDER MIXED THEREIN AND FIBER ARTICLES COMPRISING SAID FIBER

FIELD OF THE INVENTION

This invention relates to infrared slight energy radiation powder and synthetic fiber containing the radiation powder mixed therein and fiber articles comprising the synthetic fiber.

The term "fiber articles" in relation with the present invention is defined as to mean wide concept including garments such as clothes, underwear and socks; fabric apparel accessories such as handkerchieves and towels; bedding such as quilts and blankets; and wrapping articles.

DESCRIPTION OF THE PRIOR ART

Ceramics has been known as "functional material" which radiates infrared slight energy (referred often to far-infrared radiation). There has been a common understanding that ceramics acts on the object to change some physical property in radiating infrared slight energy. However, it still has not been apparent what kind of physical property can be changed in what kind of material of the object. Also, preferable components of ceramics as "functional material" has been unknown.

The infrared slight energy radiation in general heats the object directly with radiation heat like a solar beam without heating gas or liquid in between and the infrared slight energy radiation penetrates into inner part of the object like microwave heating used for a microwave oven without heating excessively the surface of the object. Therefore, the infrared slight energy radiation has been used mainly for heaters such as a stove, a cooking stove and a kotatsu, namely, a low, covered table with a heat source underneath. The infrared slight energy radiation has also been utilized in a traditional method of cooking for sweet potatoes baked in pebbles. The potatoes are baked comfortably warm by the infrared slight energy radiation from the heated pebbles.

The infrared slight energy radiation has been known as useful for the heaters, however, it has become clear that the infrared slight energy radiation particularly serves for food maturity, food freshness-keeping, taste improvement, atmosphere ionizing and the like. The mechanism is not fully explained, however, the infrared slight energy is proved to be effective in food and living use besides the industrial use through the experiments conducted by the inventor of the present invention.

In the expanding need of the infrared slight energy radiation prospected in the fields described above, it is known that effects can not be fully expected unless infrared slight energy is irradiated or radiated with the wavelength suitable for each material of the object. Therefore, ceramics functioning as a "infrared slight energy radiator" which provides sufficient quantities of infrared slight energy radiation having wider wavelength range is required for the material. And researches on the components of ceramics for the functional material has been expected to be disclosed.

In view of the situation described above, the inventor of the present invention previously proposed infrared slight energy radiation powder which provides sufficient radiant quantities of far-infrared having wide wavelength range. (Refer to Japanese Patent Publication No. 24837/1989).

As the radiation powder in accordance with the previous invention has been greatly effective, the development in other types of radiation power has been expected which would be able to radiate no less effective infrared slight energy than that of the previous invention. The development in the effective use of the radiation powder has also been expected to be proposed.

OBJECTS OF THE INVENTION

In response to the need described above, this invention discloses substituting titanium for silica in the previous invention. Also, this invention discloses substituting palladium for platinum in the previous invention. Precisely, the feature of this invention is to provide infrared slight energy radiation powder comprising alumina and titanium with platinum or palladium added as additives, or, to provide infrared slight energy radiation powder comprising alumina and silica with palladium added as additives. Silica and titanium in this invention are both essential substances that without silica or titanium, the principal purpose of providing sufficient quantities of infrared slight energy radiation can not be achieved. This invention also discloses synthetic fiber containing the radiation powder dispersedly mixed therein.

The radiation powder comprising in accordance with the above-described components having fabricated into other forms or shapes for adapting to the objects provides high energy ratio in the wavelength range (more than wavelength 4 μm) and satisfactory radiant quantities both in relatively low temperature region (less than 700° K.) and in relatively high temperature region (700°~1300° K.). Generally, with the coverage of 3~12 μm wavelength, the radiation powder is applicable to various purposes of use.

In applying the radiation powder into synthetic fiber, for example, nylon, in dispersed condition, infrared slight energy is radiated from whole of the fabric. Thus, stockings or underwear made of the fiber are so warm that they have curative effects for cold-blooded nature and arthalgia caused by the cold. Another meritorious purpose of the radiation powder is utilizing for wrapping articles which are effective for the wrapped food in maturity, keeping for a long time and freshness-retaining.

DESCRIPTION OF THE PREFERRED EMBODIMENTS

As stated above, the present invention is to provide the infrared slight energy radiation powder, an example of which comprises chiefly alumina and titanium with platinum added as additives.

Preferably, 30~45 wt % of more than 99.9% purity powdered sintered-alumina, a grain size being less than 1 μ is mixed with 55~70 wt % of powdered titanium, a grain size of which may be similar to that of alumina. And colloidal platinum, a grain size of which is roughly 7~40 Å is added to serve for oxygen and hydrogen absorption, namely, colloid activation. For further effects, silicon nitride, a grain size being less than 0.34 μ may be added to the basic constituent described above. Silicon nitride activates hydrogen in regulating hydrogen ion migration to a determined direction. Addition of 2.3 wt % of silicon nitride is preferable. The radiation powder can be in a state of powder, or fabricated into a high molecular pellet or a sheet.

Figure 1:
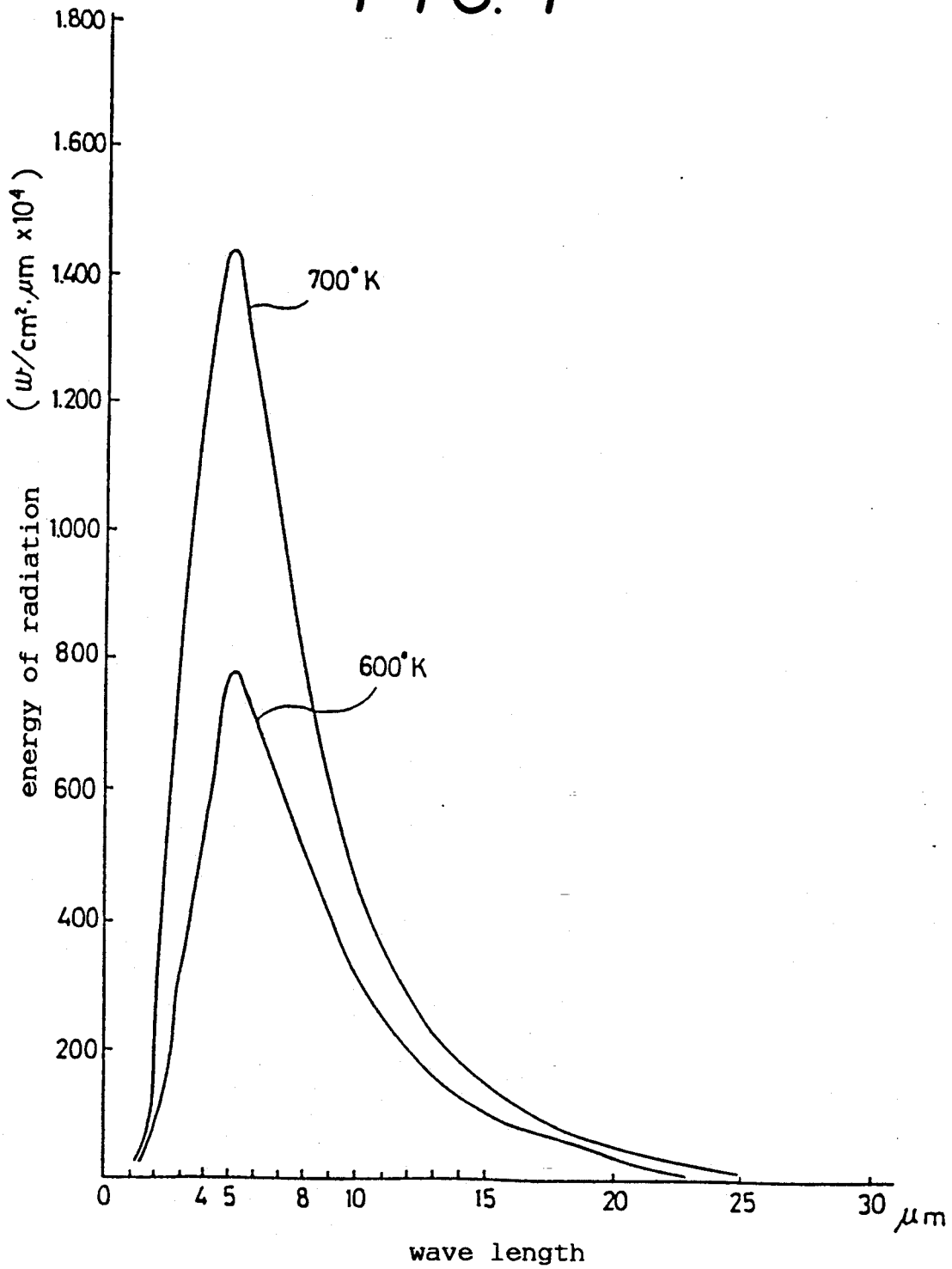
FIG. 1 is a graph of energy radiant quantities versus wavelength showing radiation features of infrared slight energy in relatively low temperature region radiated from a sheet made of the radiation powder in accordance with an example of this invention.
Figure 2:
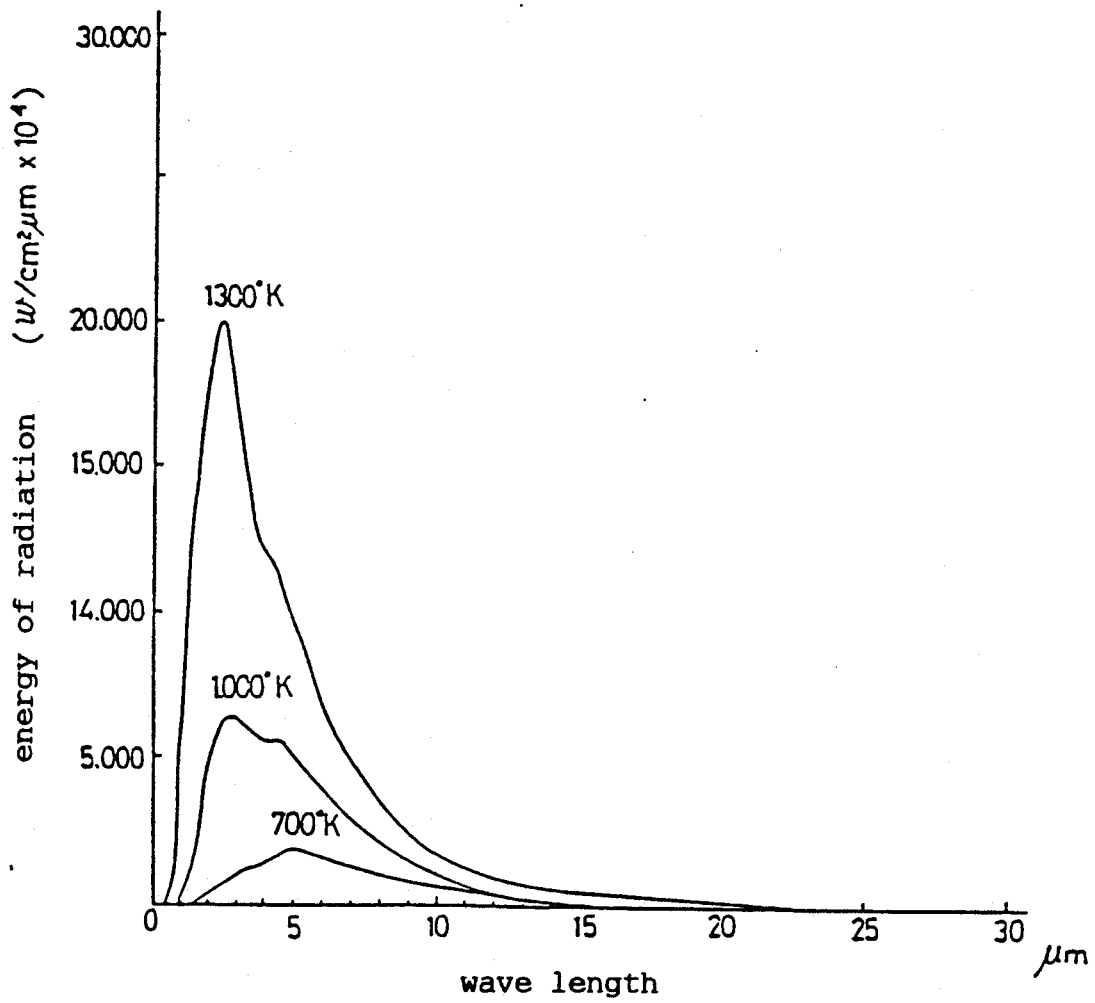
FIG. 2 is a graph corresponding to FIG. 1 in relatively high temperature region.

In investigating infrared slight energy radiant quantities radiated from a sheet which is 0.3 mm in thickness, it has been proved that energy ratio is high in the wavelength range (more than wavelength 4 μm) and satisfactory radiant quantities have been obtained in both relatively low temperature region (less than 700° K.), [FIG. 1], and relatively high temperature region (700°~1300° K.). [FIG. 2].

Furthermore, the same result is obtained by substituting palladium for platinum in the above investigation.

Also, the same result is obtained by substituting 67.6~52.3 wt % of silica for 55~70 wt % of titanium.

And in accordance with the known method, the radiation powder in relation with the example is mixed into synthetic fiber such as nylon, vinylon, ester, acrylic and urethane in dispersed condition. The following fiber articles are made of the synthetic fiber.

Clothes: Panty Hoses, Underwear

The infrared slight energy radiation from the fiber composing panty hoses or underwear penetrates into human body to improve the circulation of the blood so that those clothes are warm and retain heat. The fabric is not necessarily made of 100% fiber in relation with this invention but the desired effects can be obtained by the fabric mixed-span with ordinary fiber. The fiber containing the radiation powder dispersedly mixed in it may be used for the specific parts of the body, such as knees and elbows to obtain curative effects for cold-blooded nature or arthralgia caused by the cold. Thus, the fiber contributes to the health in a way that the infrared slight energy from the fiber absorbed deeply into the body activates water molecules in the cells. The activated water molecules further activate the cells of the body to function for metabolism in discharging egesta in the cells. Improved circulation of the blood and body fluid carrying oxygen and nutrition to all over the body results in healthy condition of the cells.

Bedding: Blankets, Quilts

The bedding such as quilts, blankets and pillows made of the fiber in relation with the present invention not only retains heat and improves the circulation of the blood but also deodorizes and keeps soft and dry feeling due to the infrared slight energy radiation from itself. The examination has been carried out on the temperature distribution of the three cases, a quilt made of the fiber in relation with the present invention, a feather quilt and a woolen quilt, in 30 minutes after start using. The quilt made of the fiber in relation with the present invention has shown better results than the feather quilt or the woolen quilt which are substantially heat-retaining. Precisely, I have examined human body temperature distribution through the thermo eye vision and it has been proved that higher body temperature is shown as a whole when the human body is covered with the quilt made of the fiber in relation with the present invention rather than covered with a feather quilt or a woolen quilt. Furthermore, as the human body, too, radiates infrared slight energy, though the quantity is little, the infrared slight energy is amplified by the mutual action in such a manner that the infrared slight energy radiated from the quilt is absorbed by the human body, and the infrared slight energy radiated from the human body is absorbed by the quilt. Thus, the effects are fairly enhanced.

Wrapping Articles

Non woven fabric for wrapping articles is made of the fiber mixedly containing the radiation powder in relation with the present invention. The wrapping articles considerably keep freshness of the wrapped perishable food. That is, the fresh meat and fish comprises more than 70% water, so that the water molecules of which are activated, as a matter of course the cells of the meat and the fish are kept in a fresh condition. The infrared slight energy radiation from the fiber resonants with the water molecules in the cells of the meat or fish. Consequently, the water molecule cluster including hydrogen ion and hydroxide ion is reduced in size fastening the ionic bonds to improve oxygen activation in the cells and to decrease water liberation from the surface of the meat and fish for effecting inhibition of aerobic bacteria propagation and browning of the food.

Figure 3:
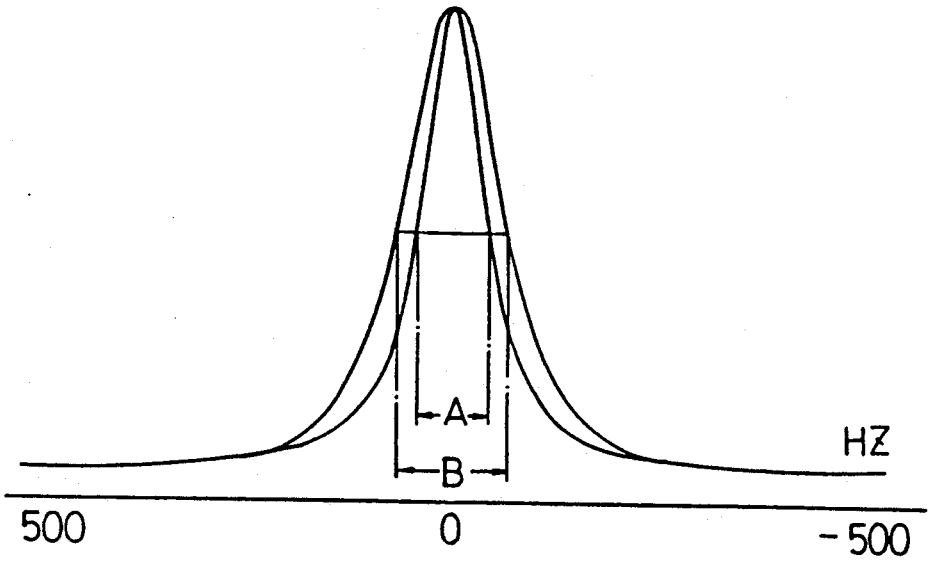
FIG. 3 is a graph showing a comparison between the size of a water molecular cluster of water having infrared slight energy radiation and without having the radiation.

To establish the above described matters, FIG. 3 shows the comparison made by NMR spectrum (nuclear magnetic resonance spectrum) in the size of water molecule clusters between water content of a fish wrapped in a wrapping article made of non woven fabric in relation with this invention and water content of a fish wrapped in a wrapping article made of the conventional non woven fabric. It has been apparent from the result that A showing the size of a water molecule cluster of water having infrared slight energy radiation is smaller than B showing the same without having infrared slight energy radiation. This shows that the water molecule cluster has been broken to be smaller by the human action of radiating infrared slight energy. Reduction of the water molecule cluster in size means that activated water molecules function as to re-include dissolved oxygen in the cluster, changing the structure of water, which results in inhibition of bacteria propagation.

EFFECTIVENESS OF THE INVENTION

As described above, the infrared slight energy radiation powder in relation with the present invention is preferable as a material functioning for radiating infrared slight energy. The radiation powder can be in a state of powder or fabricated into a pellet, a sheet or in any shapes in response to the form, construction or material of the object. Furthermore, the radiation powder has a various use in prospect as it can provide sufficient quantities of infrared slight energy radiation having wide wavelength range.

The synthetic fiber with the radiation powder mixed therein is preferable for clothes and bedding because of the effectiveness of infrared slight energy radiation from the fiber for heat-retaining and improving the health. Wrapping articles made by the synthetic fiber in relation with this invention keep freshness of the wrapped food and have antibacterial effects.

What is claimed is:

1. An infrared slight energy radiation powder mixture comprising 30–45 wt % of more than 99.9% purity powdered sintered-alumina, 55–70 wt % of more than 99.9% purity titanium and 0.1–0.4 wt % colloidal platinum or palladium.

2. An infrared slight energy radiation powder mixture as claimed in claim 1 further comprising about 2.3 wt % of silicon nitride powder.

3. The infrared slight energy radiation powder mixture as claimed in claim 1 wherein said sintered-alumina and said titanium have a grain size less than about 1 micron and said colloidal platinum or palladium has a grain size between about 7 and 40 angstroms.

* * * * *